United States Patent [19]

Isoda

[11] Patent Number: 5,061,105

[45] Date of Patent: Oct. 29, 1991

[54] REMOVABLE CAP OF WRITING INSTRUMENT

[75] Inventor: Takashi Isoda, Yokohama, Japan

[73] Assignee: Mitsubishi Pencil Co., Ltd., Tokyo, Japan

[21] Appl. No.: 465,668

[22] Filed: Dec. 15, 1989

[30] Foreign Application Priority Data

Jun. 15, 1989 [JP] Japan ..... 1-69104[U]

[51] Int. Cl.[5] ..... B43K 5/00; B43K 9/00

[52] U.S. Cl. ..... 401/202; 401/213; 401/243; D19/57

[58] Field of Search ..... 401/202, 213, 243; D19/57

[56] References Cited

U.S. PATENT DOCUMENTS 4,844,642 7/1989 Inaba et al. ..... 401/202 X
4,915,529 4/1990 List ..... 401/202

FOREIGN PATENT DOCUMENTS 0330877 9/1989 European Pat. Off. ..... 401/213
6111016 6/1983 Japan ..... 401/213
2174374 11/1986 United Kingdom ..... 401/243

*Primary Examiner*—Richard J. Apley
*Assistant Examiner*—D. F. Crosby
*Attorney, Agent, or Firm*—Armstrong, Nikaido, Marmelstein, Kubovcik & Murray

[57] ABSTRACT

A removable cap attached to a writing instrument in an insertion manner for preventing ink from evaporating from the writing instrument, includes: a hollow cylindrical cap main body provided with a trunk portion in which at least one ventilating hole is provided and a hollow cylindrical inner cap fixedly mounted in the cap main body. The cap having been detached from the writing instrument permits open air to axially flow through the interior space of the cap through a front axial opening of the cap ventilating holes in the inner cap a space defined between the inner cap and the cap main body and a ventilating hole formed in the peripheral wall of the cap main body at a position under the pocket clip of the marking pen.

1 Claim, 2 Drawing Sheets

REMOVABLE CAP OF WRITING INSTRUMENT

BACKGROUND OF THE INVENTION

1. Field of the Invention

The present invention relates to an improvement of a removable cap attached, in an insertion manner, to a front-end portion of a writing instrument such as marking pens, markers, water-color ink ball point pens and the like so as to protect an ink-applying portion of the writing instrument from damage and also so as to prevent ink from evaporating from the writing instrument.

2. Description of the Prior Art

In general, removable caps attached to the writing instruments such as marking pens, markers and the like are made of resin material which is excellent in properties preventing ink from evaporating from the writing instruments. A conventional type of the removable caps of the writing instruments has a construction as shown in FIGS. 3 to 6, in which: a conventional removable cap 24 has a double-walled construction closed as its rear end and opened at its front end so as to provide an inner-cap portion 25 in an inner space 26 of the cap 24. When the cap 24 is attached to a front-end portion of a writing instrument, the inner space 26 of the cap 24 is hermetically sealed.

Consequently, the conventional removable cap of the writing instrument having the above construction is excellent in properties of preventing ink from evaporating from the wiring instruments and in properties of protecting the ink-applying portion of the writing instrument from damage, and therefore, there is no problem in writing use itself. However, since the conventional removable cap 24 having the above construction is completely closed at its rear end, there is a fear that the cap 24 can suffocate an if the infant swallows the cap 24 whole. Thus, it is apparent that the need exists for an improved removable cap which will prevent ink from evaporating from a writing instrument and protect an ink-applying portion of the writing instrument from damage without fear that the cap suffocate an infant's bronchi even if the infant swallows the cap whole.

SUMMARY OF THE INVENTION

It is an object of the present invention to provide an improved removable cap attached to a writing instrument in an insertion manner, which cap can prevent ink from evaporating from the writing instrument as is in the case of the conventional cap and is provided with an axial ventilating means for ventilating an inner space of the cap itself, the means being able to prevent an infant from being chocked by the cap when the infant swallows the cap whole.

The above object of the present invention is accomplished by providing:

A removable cap attached to a writing instrument in an insertion manner for preventing ink from evaporating from the writing instrument and for protecting an ink-applying portion of the writing instrument from damage, comprising:

a hollow cylindrical cap main body having its front end opened and its rear end closed, the cap main body being provided with at lease one ventilating hole in its trunk portion; and a hollow cylindrical inner cap fixedly mounted in the cap main body, the inner cap being closed at its rear end while opened at its front end, and outer diameter of which inner cap is smaller than an inner diameter of the cap main body, the inner cap being shorter in axial length than the cap main body while provided with: an outer flange in its front end, which outer flange radially extends outwardly and is press-fitted to an inner wall of the cap main body for fixedly mounting the inner cap in the cap main body; and at least one ventilating hole provided in the vicinitiy of said outer flange of the inner cap.

DESCRIPTION OF THE PREFERRED EMBODIMENTS

The present invention will be described hereinbelow, by way of example, in detail with reference to FIGS. 1 to 2 of the accompanying drawings. Since many changes and modifications can be made to the following construction without departing from the scope of the present invention, it is intended that all matters given in the following description and illustrated in FIGS. 1 to 2 of the accompnaying drawings shall be interpreted to be illustrative only and not as a limitation to the scope of the present invention.

Figure 1:
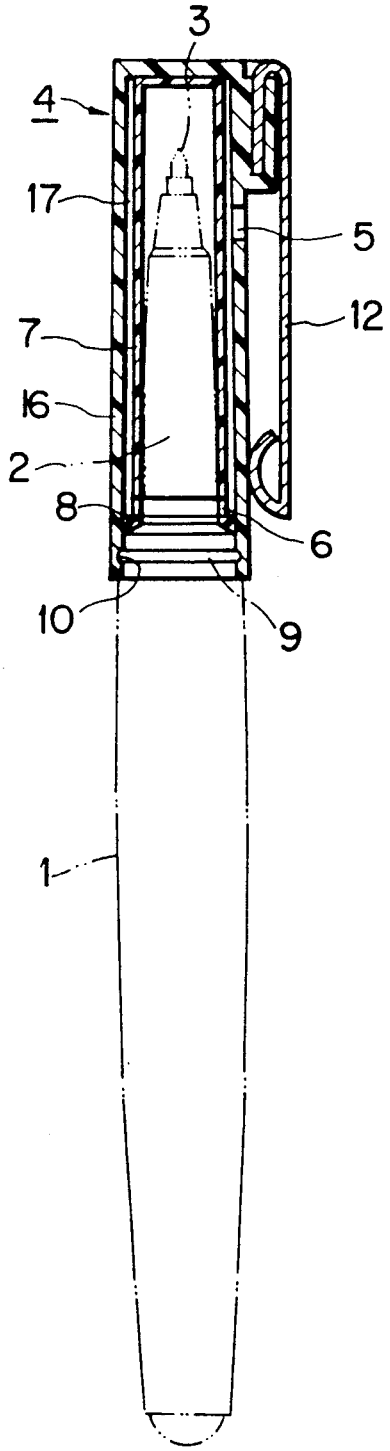
FIG. 1 is a partially longitudinal sectional view of an embodiment of a removable cap of the present invention attached to a writing instrument in an insertion manner.
Figure 2:
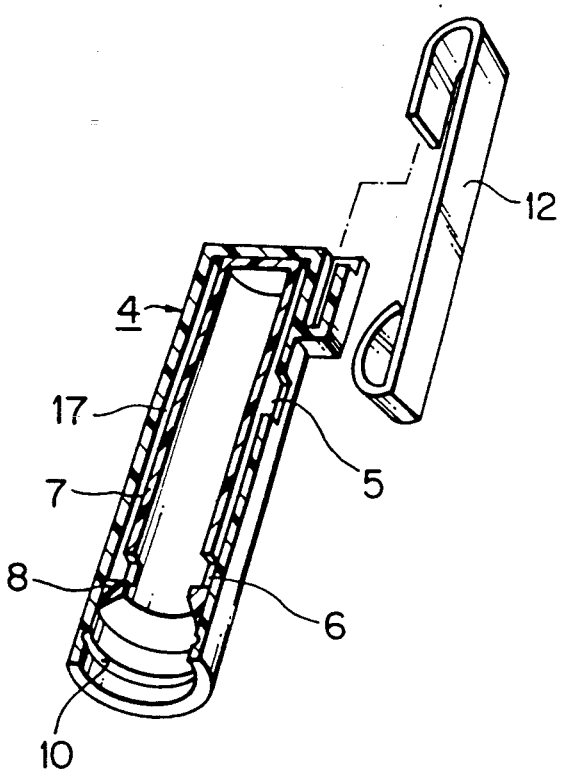
FIG. 2 is a perspective longitudinal sectional view of the cap of the present invention shown in FIG. 1.
Figure 3:
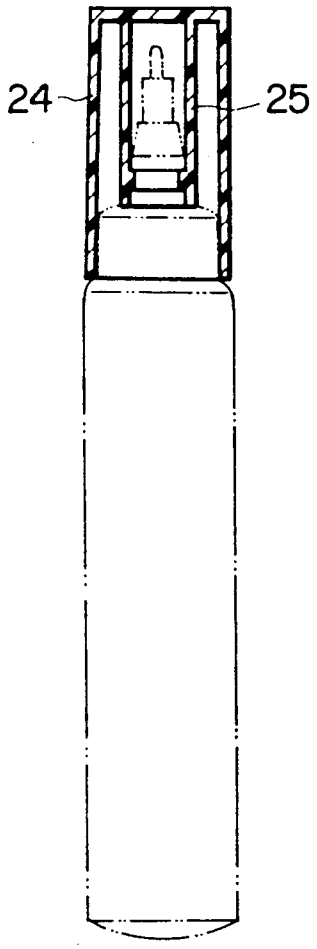
FIG. 3 PRIOR ART
FIG. 3 is a partially longitudinal sectional view of a conventional cap.
Figure 4:
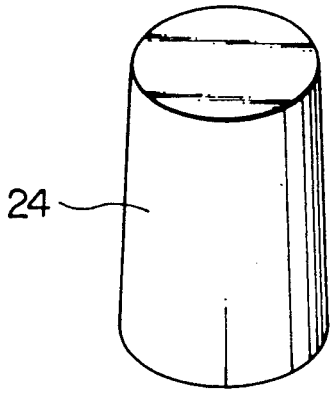
FIG. 4 PRIOR ART
FIG. 4 is a perspective view of the conventional cap shown in FIG. 3.
Figure 5:
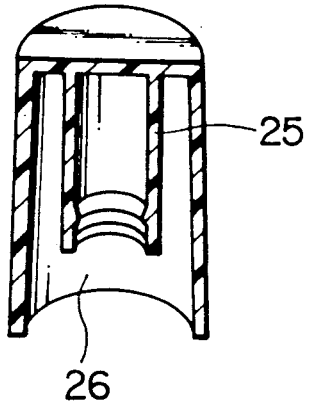
FIG. 5 PRIOR ART
FIG. 5 is a perspective longitudinal sectional view of the conventional cap shown in FIG. 3.
Figure 6:
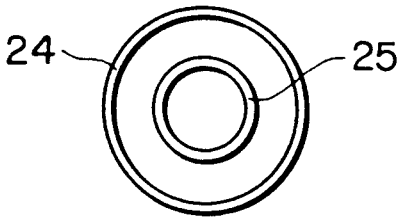
FIG. 6 PRIOR ART
FIG. 6 is a bottom view of the conventional cap shown in FIG. 3.

FIGS. 1 to 2 show an embodiment of a removable cap 4 of the present invention attached to a marking pen 1 in an insertion manner. The cap 4 assumes a hollow cylindrical shape and is detachably mounted on a front-end portion of the marking pen 1 to cover an ink-applying portion 3 of the marking pen 1.

The cap 4 is constructed of: a cap main body 16 made of a synthetic resin,; and an inner cap 7 which is fixedly mounted in the cap main body 16 while made of a synthetic resin.

The cap main body 16 assumes a cylindrical shape having its front end opened and its rear end closed. A pocket clip 12 constructed of a bent metal plate is fixedly mounted on an outer wall of a rear-end portion of the cap main body 16. In the embodiment of the present invention shown in FIG. 1, although the pocket clip 12 constitutes a separate member, it is possible that the pocket clip 12 is integrally formed with the cap main body 16.

The cap main body 16 is provided with a peripheral groove 10 in an inner wall of its front-end portion, which groove 10 detachably engages with a peripheral ridge 9 of the marking pen 1.

An outer diameter of the inner cap 7 is smaller than an inner diameter of the cap main body 16. The inner cap 7 is shorter in axial length than the cap main body 16, and has its front end opened and its rear end closed.

An inner diameter of a front-end portion of the inner cap 7 permits a front-shaft portion 2 of the marking pen 1 to hermetically engage with the inner cap 7.

The inner cap 7 is provided with an outer flange 8 in its front end, which outer flange 8 radially extends outwardly from the front end of the inner cap 7.

The outer flange 8 of the inner cap 7 is press-fitted into the cap main body 16 so that the inner cap 7 is fixedly mounted in the cap main body 16.

A pair of diametrically opposed ventilating holes 6 are formed in a peripheral wall of the inner cap 7 at positions behind the outer flange 8 of the inner cap 7. These ventilating holes 6 of the inner cap 7 are hermetically closed by means of the front-shaft portion 2 of the marking pen 1 when the cap 4 is attached to the marking pen 1.

In assembling of the cap 4 of the present invention, the inner cap 7 is forcibly inserted into the cap main body 16 until the rear-end surface of the inner cap 7 abuts on an inner surface of the bottom of the cap main body 16. The thus forcibly inserted inner cap 7 is press-fitted to an inner wall of a predetermined position of the cap main body 16 by means of the other flange 8 of the inner cap 7.

A suitable clearance 17 is provided between an outer peripheral surface of the inner cap 7 and an inner peripheral surface of the cap main body 16.

The pocket clip 12 is fixedly mounted on the cap main body 16 in a conventional manner. As is clear from FIG. 2, another ventilating hole 5 is formed in a peripheral wall of the cap main body 16 at a position under the pocket clip 12. The number and the position of the ventilating hole 5 may be varied.

The cap 4 of the present invention having been detached from the marking pen 1 permits open air to axially flow through the cap 4 through the front-end opening of the cap main body 16, ventilating holes 6, space 17 and ventilating hole 5.

Consequently, there is no fear that the cap 4 having been detached from the marking pen 1 suffocates infant's bronchi even if the infant swallows the cap 4 whole.

When the cap 4 of the present invention is mounted on the marking pen 1, both of the front-end opening of the inner cap 7 and the ventilating holes 6 of the inner cap 7 are hermetically closed by the marking pen 1 to permit the interior space of the inner cap 7 to be hermetically sealed, whereby the cap 4 of the present invention can prevents ink from evapolating and protects the ink-applying of the writing instrument from damage.

What is claimed is

1. A removable cap attached to a writing instrument in an insertion manner for preventing ink from evaporating from said writing instrument and for protecting an ink-applying portion of said writing instrument from damage, comprising:

a hollow cylindrical cap main body having its front end opened and its rear end closed, said cap main body being provided with a pocket clip integrally formed with the cap main body, the pocket clip being attached to the cap main body at a location adjacent the closed end and extending axially parallel to and spaced away from the outer surface of the cap main body, and with at least one ventilating hole in its cylindrical wall portion, the hole being positioned directly beneath the pocket clip so as to prevent any surface from covering and therefore closing the hole; and a hollow cylindrical inner cap fixedly mounted in said cap main body, said inner cap being closed at its rear end while opened at its front end, an outer diameter of which inner cap is smaller than an inner diameter of said cap main body, said inner cap being shorter in axial length than said cap main body while provided with an outer flange in its front end, the outer flange radially extending outwardly and being press-fitted to an inner wall of said cap main body for fixedly mounting said inner cap in said cap main body; and at least one ventilating hole providing in said vicinity of said outer flange of said inner cap.

* * * * *